US007607278B2

(12) United States Patent
Witkowski

(10) Patent No.: US 7,607,278 B2
(45) Date of Patent: Oct. 27, 2009

(54) METHOD AND DEVICE FOR BUNDLING RECYCLABLE PAPER

(76) Inventor: Robert Witkowski, 2016 Longewood La., Toms River, NJ (US) 08755

( * ) Notice: Subject to any disclaimer, the term of this patent is extended or adjusted under 35 U.S.C. 154(b) by 0 days.

(21) Appl. No.: 12/072,377

(22) Filed: Feb. 27, 2008

(65) Prior Publication Data

US 2009/0211466 A1 Aug. 27, 2009

(51) Int. Cl.
*B65B 27/08* (2006.01)
*B65B 13/02* (2006.01)

(52) U.S. Cl. ..... 53/399; 53/413; 53/414; 53/134.1; 53/139.4; 53/592; 24/18; 24/130; 100/1; 100/2; 100/8; 206/451

(58) Field of Classification Search ..... 53/399, 53/413, 414, 590, 582, 592, 134.1, 139.4, 53/390; 24/18, 130; 100/1, 2, 8, 34; 206/451; *B65B 27/08, 25/14, 67/08*
See application file for complete search history.

(56) References Cited

U.S. PATENT DOCUMENTS

| | | | | | |
|---|---|---|---|---|---|
| 736,499 | A * | 8/1903 | Crawford | 24/18 |
| 736,629 | A * | 8/1903 | Priddat | 24/18 |
| 757,820 | A * | 4/1904 | Lykke | 24/130 |
| 793,202 | A * | 6/1905 | Kux | 24/18 |
| 835,656 | A * | 11/1906 | Amann | 24/18 |
| 897,795 | A * | 9/1908 | Smith | 24/18 |
| 1,247,008 | A * | 11/1917 | Reinheimer | 24/18 |
| 1,806,162 | A * | 5/1931 | Hahn | 24/18 |
| 2,334,728 | A * | 11/1943 | Scott | 24/18 |
| 2,346,538 | A * | 4/1944 | Kleinmann | 24/18 |
| 2,436,935 | A * | 3/1948 | Ohler | 24/18 |
| 2,458,252 | A * | 1/1949 | Chatterton | 24/18 |
| 3,119,160 | A * | 1/1964 | Hoppeler | 100/2 |
| 3,675,276 | A * | 7/1972 | Nuse | 24/130 |
| 5,533,318 | A * | 7/1996 | Murat | 53/592 |
| 2006/0107494 | A1 * | 5/2006 | Liao | 24/18 |

* cited by examiner

*Primary Examiner*—Stephen F Gerrity
(74) *Attorney, Agent, or Firm*—Clifford G. Frayne

(57) ABSTRACT

A device for bundling newspapers for recycling, the device having a cylindrical handle member having two spaced apart apertures perpendicular to the axis of the cylinder, the cylinder further having two axial slits formed in the ends thereof, the handle member cooperative with a length of cordage passing through one of the apertures in the handle member such that the cordage is of equal length from both sides of the aperture of the handle member, the cordage lengths arranged in an X configuration such that a bundle of newspapers is angularly positioned on the cordage so positioned, the handle member then drawn up over one corner of the bundle to approximately the center of the top of the bundle of newspapers, the opposing two ends of the cordage are then inserted through the second aperture in the handle member, drawn taut, and then wrapped about the opposing slits formed in the end of the handle member.

12 Claims, 10 Drawing Sheets

METHOD AND DEVICE FOR BUNDLING RECYCLABLE PAPER

BACKGROUND OF THE INVENTION

1. Field of the Invention

The present invention relates to recycling, and more particularly, to a device for securing a bundle of newspapers for transportation to a recycling location.

2. Description of the Prior Art

The recycling of newspapers commenced when it was recognized that a disproportional amount of landfill space was being taken up by newspapers and that newspapers themselves did not biodegrade as quickly as other elements in a landfill. The newspapers themselves could be chemically treated and be converted into new print paper for use.

Municipalities commenced the recycling by establishing recycling centers within the municipality where residents could drop off their newspapers, and in many municipalities, this eventually evolved into special collection days at the curb for recycled materials such as cans, bottles, and bundled newspapers.

The problem facing all individuals wishing to recycle their newspapers was a quick and easy way in which to bundle the newspapers in order to transport them either to a recycling center or to the curb for curbside pickup, while at the same time insuring that the bundle would not be too heavy, but would be secured so that the elements would not effect it such that the newspapers would be blown throughout the neighborhood.

The simplest and easy way to secure a bundle or bale of newspapers was to cut a string of sufficient length such that it could be wrapped lengthwise and widthwise about the bale or bundle of newspapers and tied on one side, the secured string or twine serving as a handle to lift and transport the newspapers to the desired location. Unfortunately, some people such as the elderly or infirm lack the strength or dexterity to maneuver the bundle or bale of newspapers as stated, and to secure the string or twine.

The recycling requirement thus led to a plurality of devices designed to assist the individual in stacking the newspapers and baling the newspapers. These came in the forms of receptacles or baling and storage containers and the like which identified to the individual as to where to stack the newspapers and position the cord or twine, and assisted in maintaining the position of the cord or twine while the individual secured the cord or twine in a knot.

Applicant's invention allows for the quick and facile securing of a bundle or bale of newspapers by an individual regardless of the individual's age or condition, does not require the individual to tie a knot in order to secure the bundle or bale of newspapers, and provides for a biodegradable handle member for the ease of lifting and transportation of the bundle or bale of newspapers to a desired location.

OBJECTS OF THE INVENTION

An object of the present invention is to provide for a novel baling and bundling device for newspaper recycling.

Another object of the present invention is to provide for a novel baling and bundling device for recycling newspapers wherein the bundling device itself is biodegradable.

A still further object of the present invention is to provide for a novel bundling and baling device for recycling newspapers which does not require the individual to tie a knot in order to secure the newspapers for recycling.

A still further object of the present invention is to provide for a novel bundling and baling device for recycling newspapers which when secured, provides a biodegradable handle for the transportation of the bundled or baled newspapers to a desired location.

A still further object of the present invention is to provide for a novel bundling and baling device for recycling newspapers which in itself is recyclable, economical to manufacture, and easy to use.

SUMMARY OF THE INVENTION

A device for bundling newspapers for recycling, the device having a cylindrical handle member having two spaced apart apertures perpendicular to the axis of the cylinder, the cylinder further having two axial slits formed in the ends thereof, the handle member cooperative with a length of cordage passing through one of the apertures in the handle member such that the cordage is of equal length from both sides of the aperture of the handle member, the cordage lengths arranged in an X configuration such that a bundle of newspapers are angularly positioned on the cordage so positioned, the handle member then drawn up over one corner of the bundle to approximately the center of the top of the bundle of newspapers, the opposing two ends of the cordage are then inserted through the second aperture in the handle member, drawn taut, and then wrapped about the opposing slits formed in the end of the handle member.

BRIEF DESCRIPTION OF THE DRAWINGS

These and other objects of the present invention will become apparent, particularly when taken in light of the following illustrations wherein.

DETAILED DESCRIPTION OF THE INVENTION

Figures 1, 2, 3:
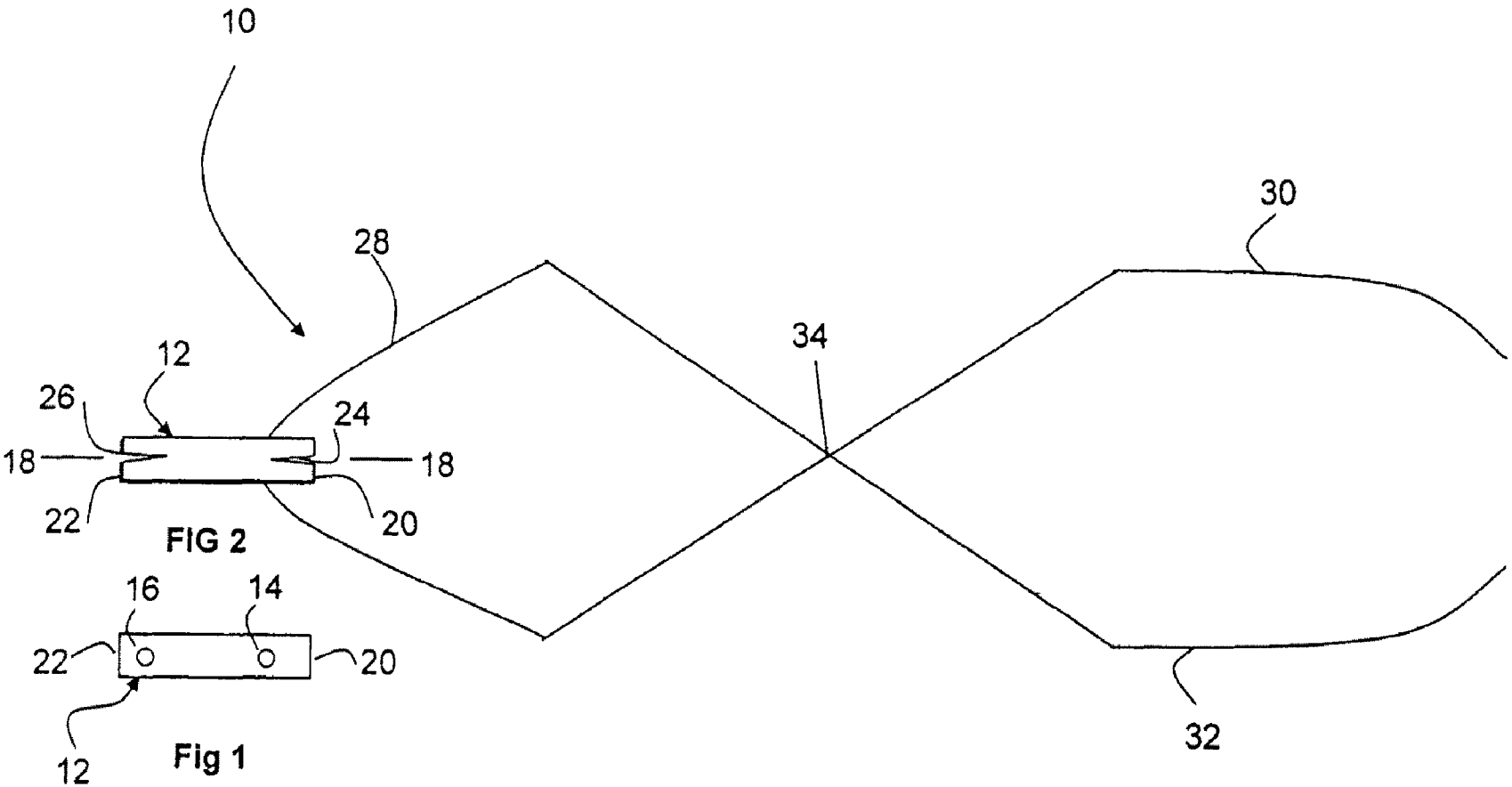
FIG. 1 is a top view of the handle member of the bundling device.
FIG. 2 is a side view of the handle member of the bundling device.
FIG. 3 is a top planar view of the handle member and cordage laid out in accordance with teachings herein.

FIG. 1 is a top view of the handle member 12, and FIG. 2 is a side view of the handle member 12, and FIG. 3 is a top plan view of the bundling device 10 of the present invention. The handle member 12 is cylindrical in shape. It is anywhere from four to six inches in length. The handle member 12 is formed with two apertures 14 and 16 which are perpendicular to the axis 18 of the handle member 12, and are in spaced apart relationship. In addition, the ends 20 and 22 of handle member 12 are formed with a V-shaped slot or notch 24 and 26. Handle member 12 is formed of recycled kraft paper or the like such that it can be included in the chemical treatment of the paper in order for the paper to be broken down and recycled into fresh print paper. Handle member 12 may be a cylindrical solid or it may be tubular to aid in biodegradability.

Figure 4:
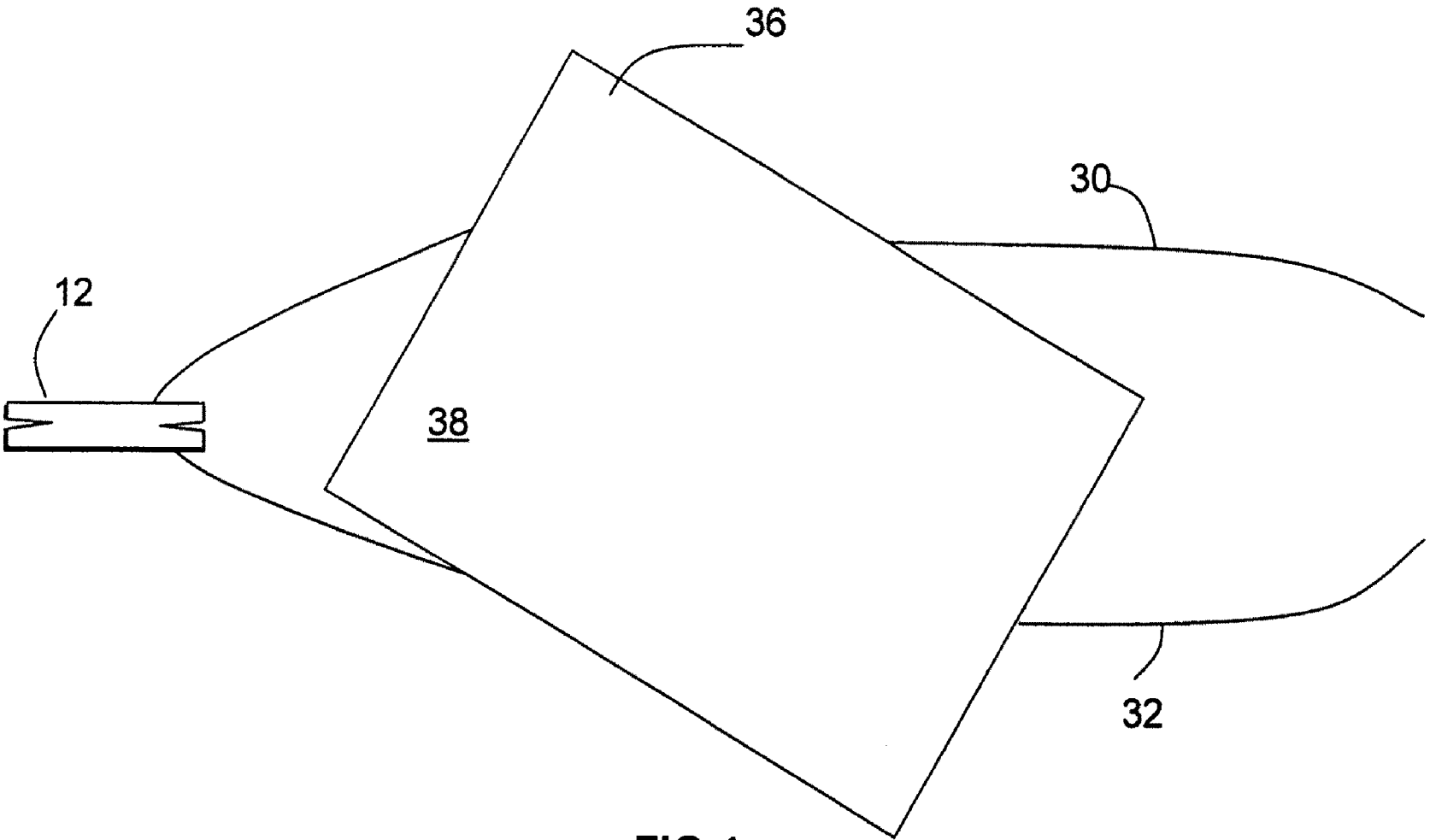
FIG. 4 is a top plan view of the device illustrating the location and positioning of the bundle of newspapers.

FIG. 3 is a top view of the handle member 12 associated with a piece of cordage 28 which defines the bundling and baling device. The cordage 28 is inserted through aperture 14 of handle member 12, and drawn out so that there are two equal lengths of cordage 30 and 32 extending from handle member 12. The length of cordage 28 can vary depending upon the size of the bundle of papers which the user wishes to bundle. However, it has been found that a total length of cordage 28 of approximately six to seven feet provides the optimum length for allowing any user, despite age or infirmity, for bundling a manageable bundle of papers of a manageable weight which would allow the user or individual to transport the bundle without difficulty. Therefore in the preferred embodiment, the length of cordage for each length of the cordage 28 would be three and a half feet. As illustrated in FIG. 3, the equal lengths of cordage 30 and 32 are criss-crossed to form an X pattern 34 on a flat surface. The bundle of newspapers 36 is then placed over the X pattern 34 of cordage lengths 30 and 32 at a 45 degree angle, such that one corner 38 of the bundle of newspapers 36 points approximately towards the handle member 12 (See FIG. 4).

Figure 5:
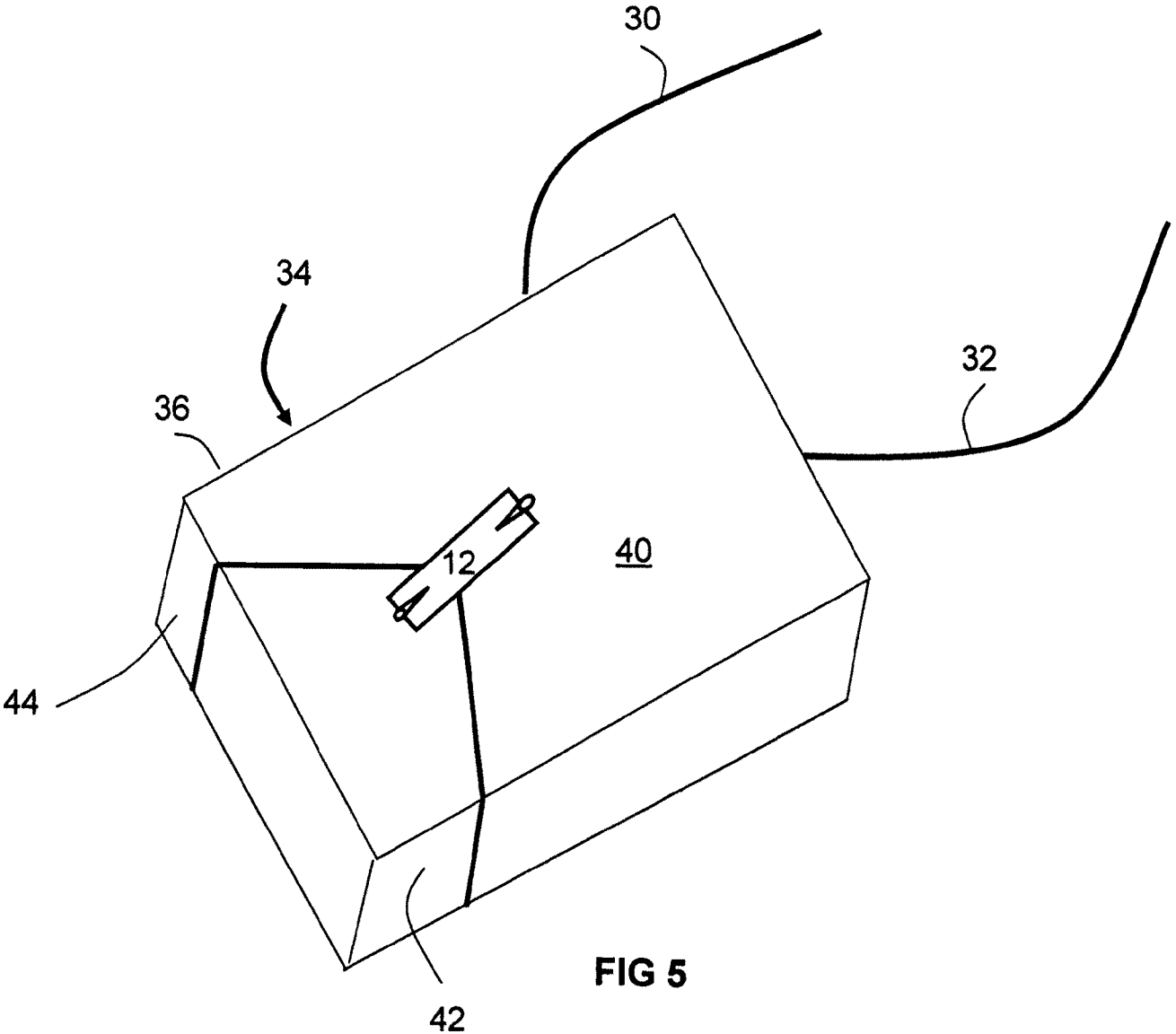
FIG. 5 is a perspective upper view of the bundling device positioned in preparation for being secured.

As illustrated in FIG. 5, the handle member 12 is then brought up and rested on the top 40 of the newspaper bundle 36 as close to the center as possible. In this configuration, one leg of the cordage 30 extends upwardly along the side 42 of the bundle of newspaper 36 while the other leg of cordage 32 extends upwardly over the adjacent side 44 of the bundle of newspapers 36.

Figure 6:
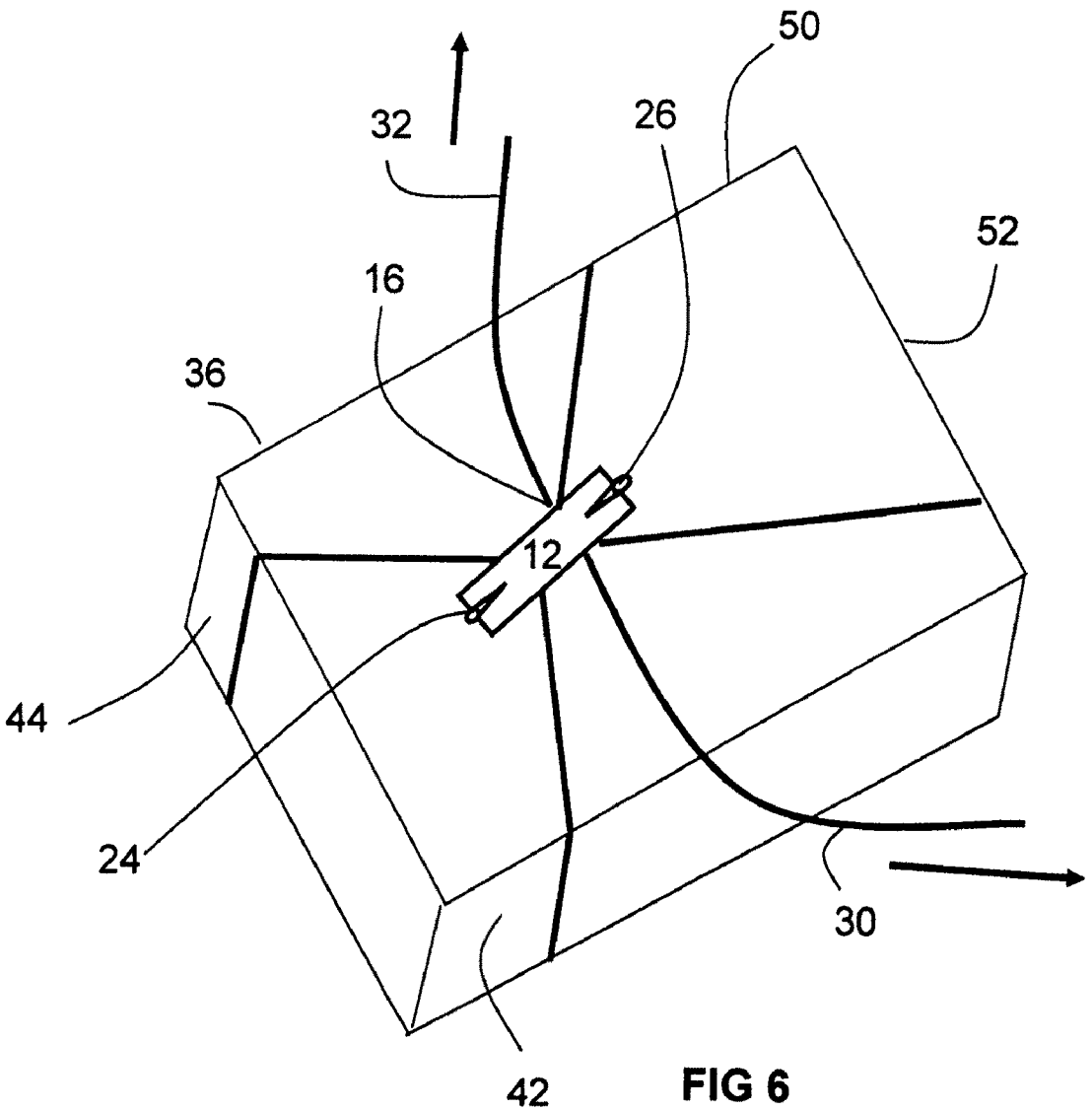
FIG. 6 is an upper perspective view of the bundling device in the process of being secured.
Figure 7:
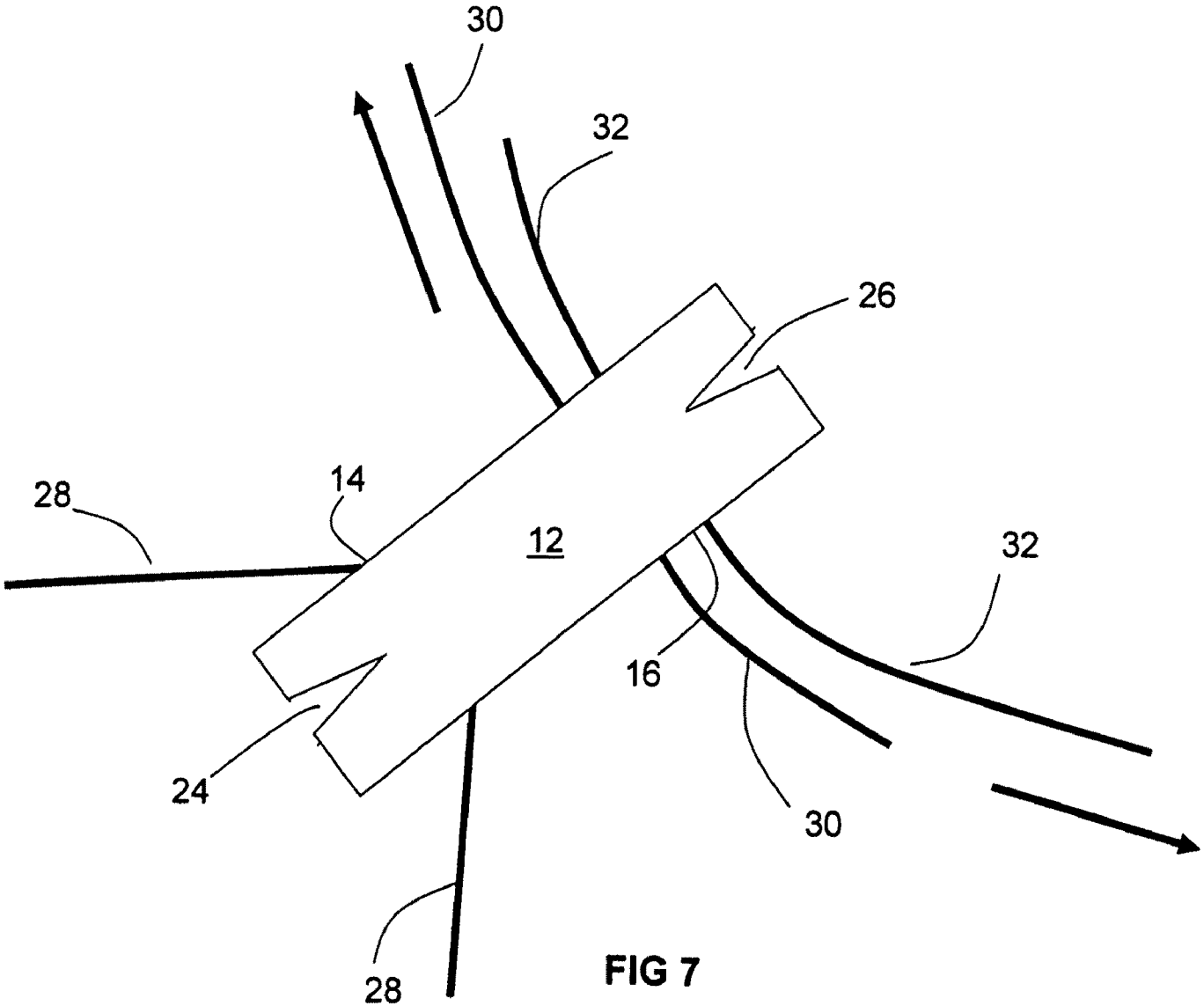
FIG. 7 is a close up top plan view of a handle member with the positioning of the cordage.
Figure 8:
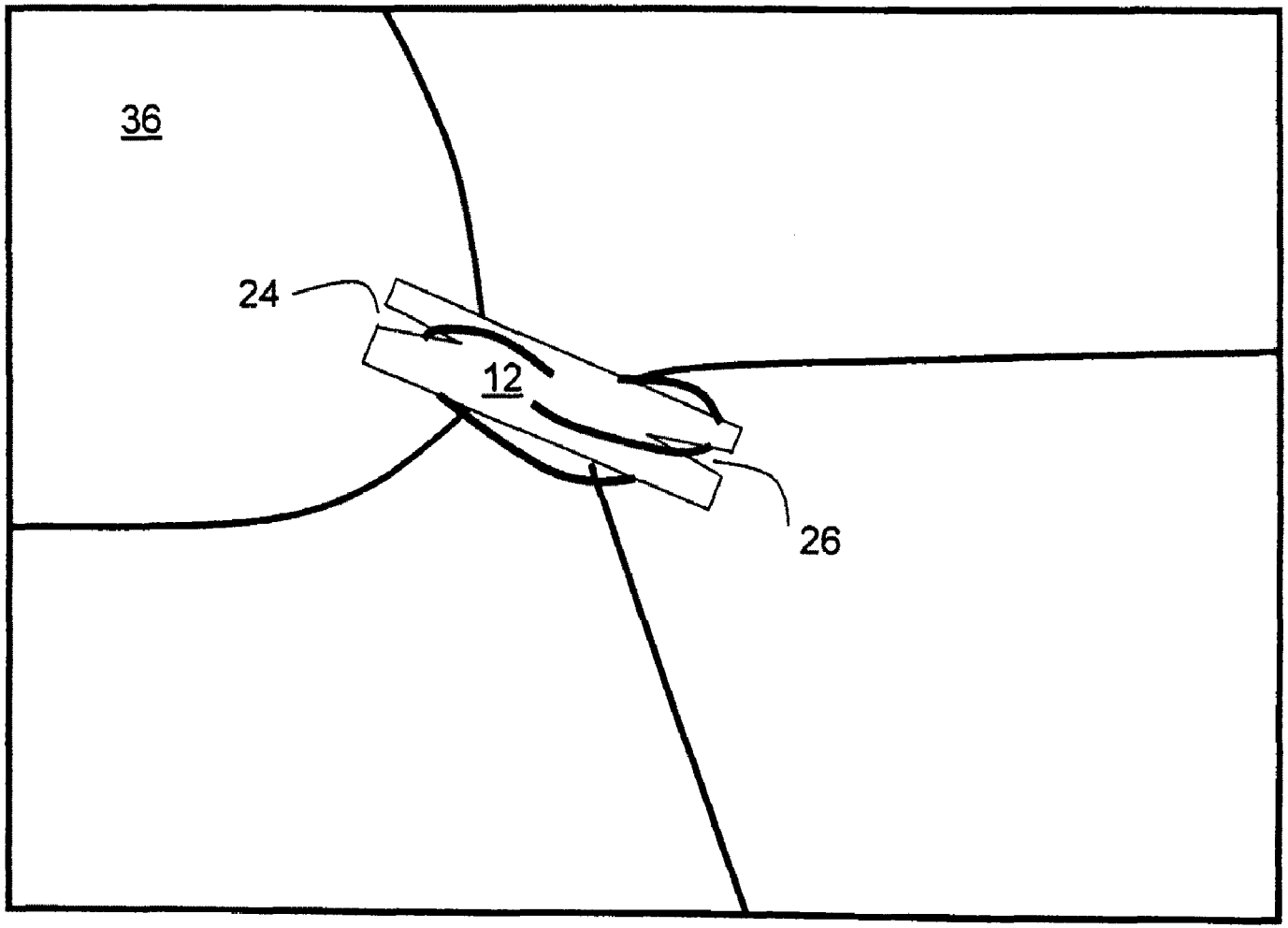
FIG. 8 is a top plan view of the handle member and secured cordage.
Figure 9:
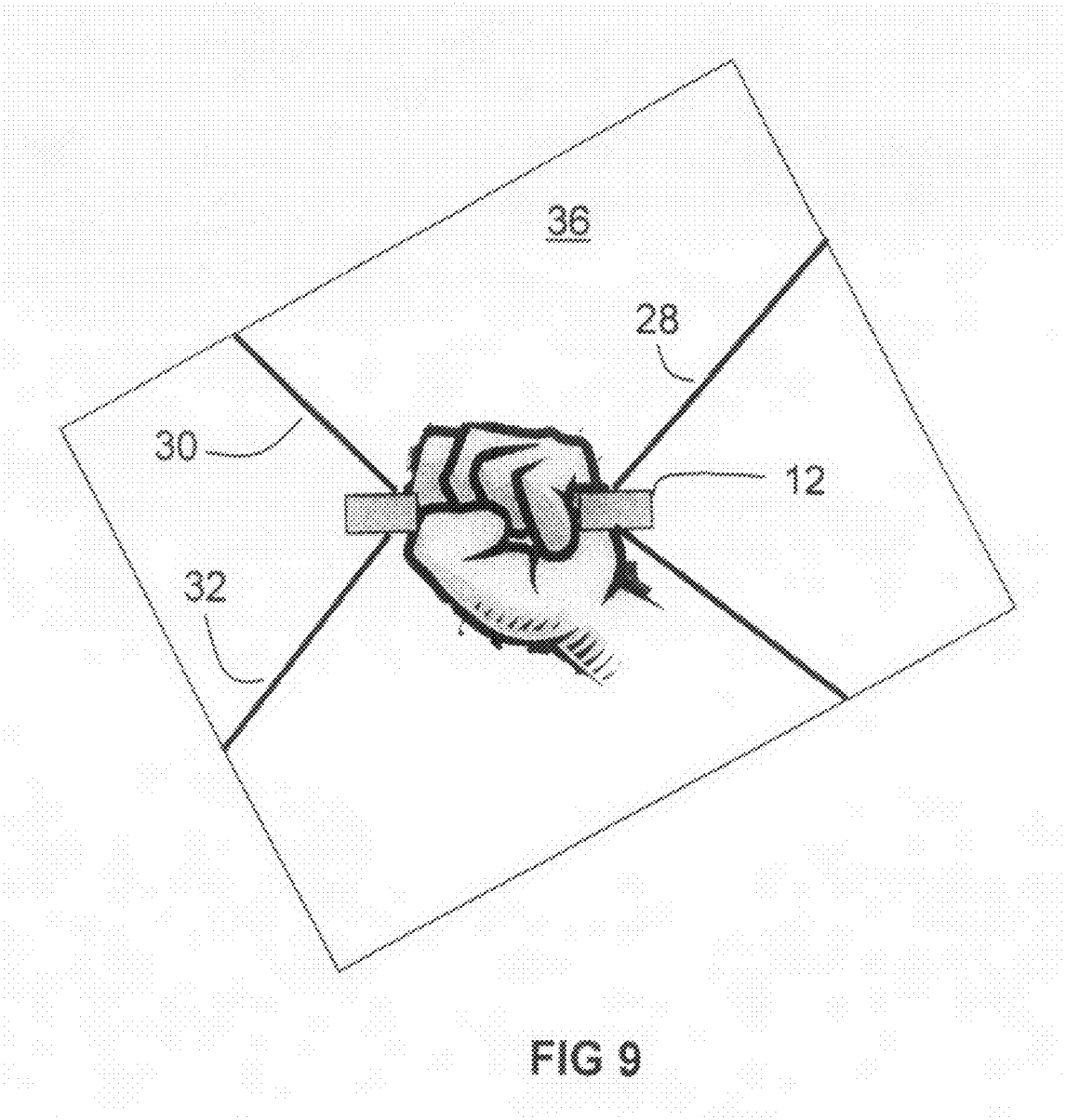
FIG. 9 is a top view of the bundling device and the secured bundled newspapers.

The remaining ends of the cordage 30 and 32 are now brought up to the top of the bundle of newspapers 36 and inserted from opposing sides through the second aperture 16 of handle member 12 and drawn tightly (See FIGS. 6 and 7). The ends of the cordage 30 and 32 are pulled tightly through the second aperture 16 of handle member 12 and then the ends of the respective cordages 30 and 32 are pulled through each of the V-shaped slot cuts 24 and 26 at the ends of handle member 12 with the excess cordage being wrapped within these V-shaped slots or notches 24 and 26 (See FIG. 8). The bundle of newspapers 36 is now secured since the loose ends of the cordage 30 and 32 now extend upwardly along side 50 of the bundle of newspapers 36 and side 52 of the bundle of newspapers 36. The crossed cordages 30 and 32 on the bottom of the bundle of newspapers 36 originally formed into an X-shaped pattern 34 form an X-shaped pattern on the bottom of the bundle, and the loose ends of the cordages 30 and 32, together with the handle member 12 and the upper ends of the cordages originally passed through the handle member 12, form an X-shaped pattern 54 on the top of the bundle, the cordage thus securing all four sides, the top and bottom of the bundle of newspapers 36. The handle member 12 is now used as a handle for the individual or user to lift the bundle and transport it to the desired location, be it the trunk of a car for transport to a recycling center, or to the curb for pick up by a recycling vehicle (See FIG. 9).

Figures 10, 11, 12:
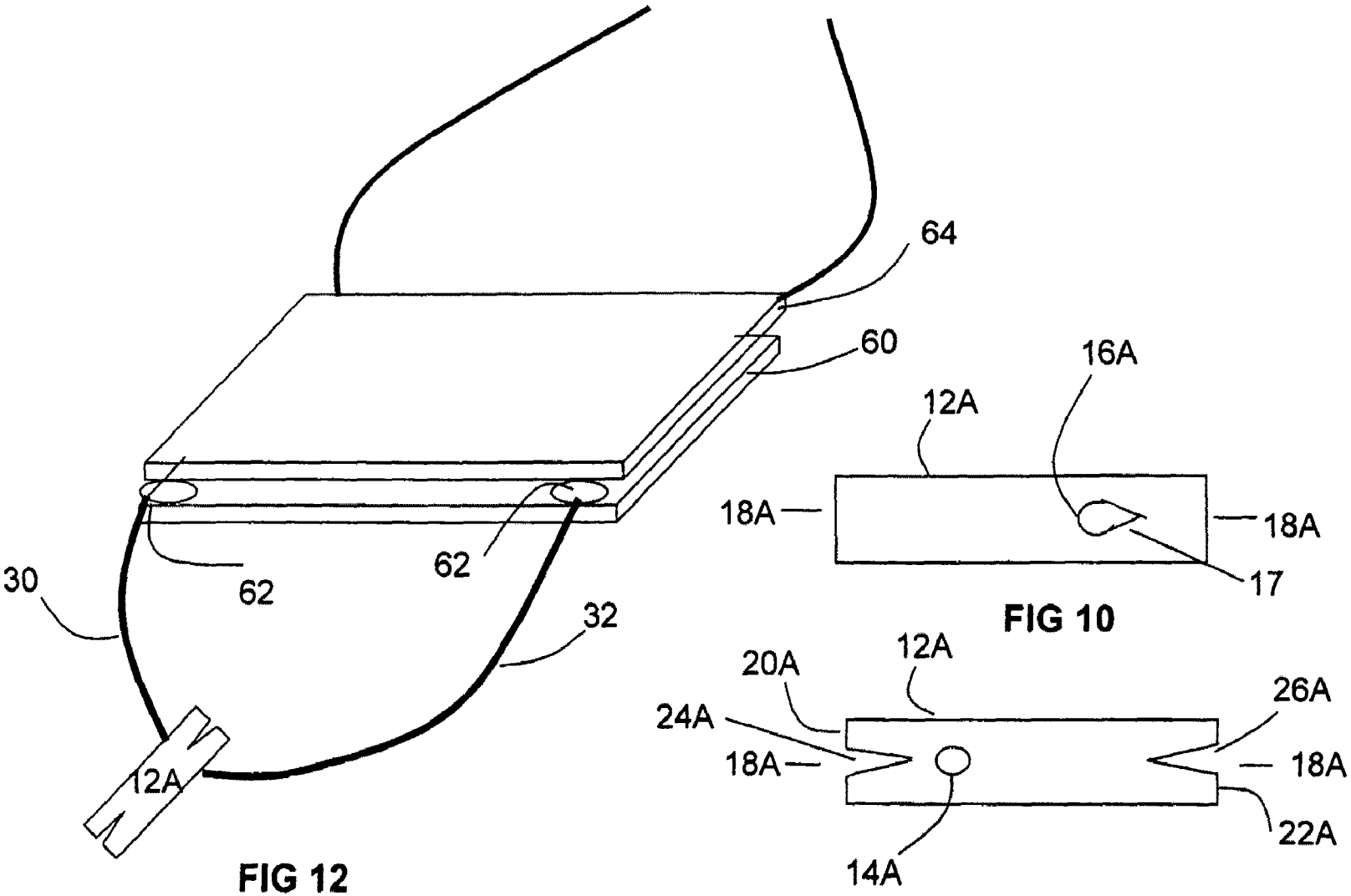
FIG. 10 is a top view of a second embodiment of a handle member.
FIG. 11 is a side view of a second embodiment of a handle member.
FIG. 12 is a perspective view of an alternative aid utilized in conjunction with the bundling device.

FIG. 10 is a top view of a second embodiment of a handle for the bundling device and FIG. 11 is a side view of the handle of FIG. 10. Handle member 12A functions in the same manner as handle member 12 in that it is cylindrical in shape and of a length of approximately 4 to 6 inches. Handle member 12A is formed with two apertures 14A and 16A, which are perpendicular to the axis 18A of handle member 12A, but the apertures 14A and 16A are spaced apart and one of the apertures 16A is formed with a slot member 17. Handle member 12A and the cordage 28, would be utilized and laid out in the same fashion as described with respect to the first embodiment, but in the second embodiment, the ends of the respective cordages 30 and 32, would be inserted through aperture 16A from the same side and drawn taut, and then the cordage ends 30 and 32 would be engaged within the slot 17 of aperture 16A to establish the tautness of the cordage 28 about the bundle of newspapers 36. The remaining cordage ends 30 and 32 would similarly be wrapped about V-shaped slot or notches 24A and 26A formed in the ends 20A and 22A of handle member 12A.

The use of the bundling device 10 of the present invention has been described thus far with respect to the positioning of the bundling device 10 on a flat surface and utilizing the equal lengths of cordage 30 and 32 to criss cross to form an X pattern 34 upon which the bundle of newspapers 36 is placed at an approximate 45 degree angle. The bundle of newspapers is then secured in accordance with the teachings herein. The positioning of cordage lengths 30 and 32 in an X pattern 34 can further be aided by sandwiching the cordage lengths 30 and 32 between two pieces of newspaper which are partially adhesed together. This is illustrated in FIG. 12 in which the cordage lengths 30 and 32 have been positioned above a piece of newspaper 60 forming the X pattern 34. A small amount of adhesive 62 in the form of glue or paste can be spread intermittently along the lengths of cordage 30 and 32 resting on the newspaper, and a second piece of newspaper 64 can then be pressed down onto the first piece of newspaper 60 being adhesed thereto by the glue and/or paste 62 such that the X pattern 34 is sandwiched between the newspapers and maintained in position while a bundle of newspapers 36 is then positioned over the X pattern again, at a 45 degree angle with the cordage lengths 30 and 32 then being engaged with a handle member 12 ore 12A in the manner described.

Figure 13:
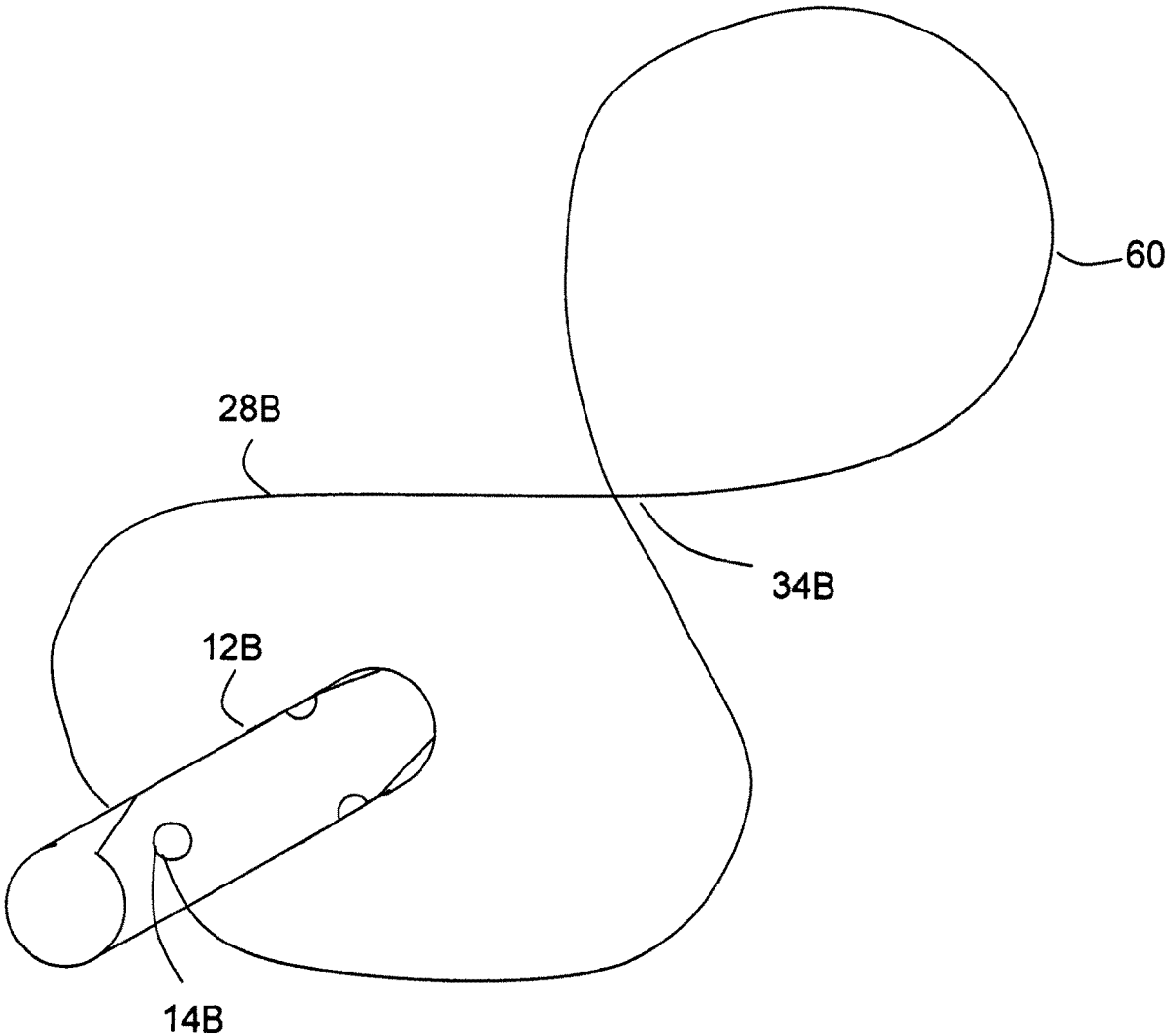
FIG. 13 is an alternative embodiment of the bundling device incorporating a different type of cordage.

FIG. 13 is an alternative embodiment of the bundling device 10 utilizing a different cordage element. The handle member 12B as illustrated in FIG. 13 is identical to either handle member 12 or handle member 12A of the earlier described embodiments. The cordage 28B is inserted through one set of apertures 14B but cordage 28B is of a continuous loop. It is formed into an X intersection 34B and the newspaper bundle 36 is placed on the X intersection at a 45 degree angle.

Figure 14:
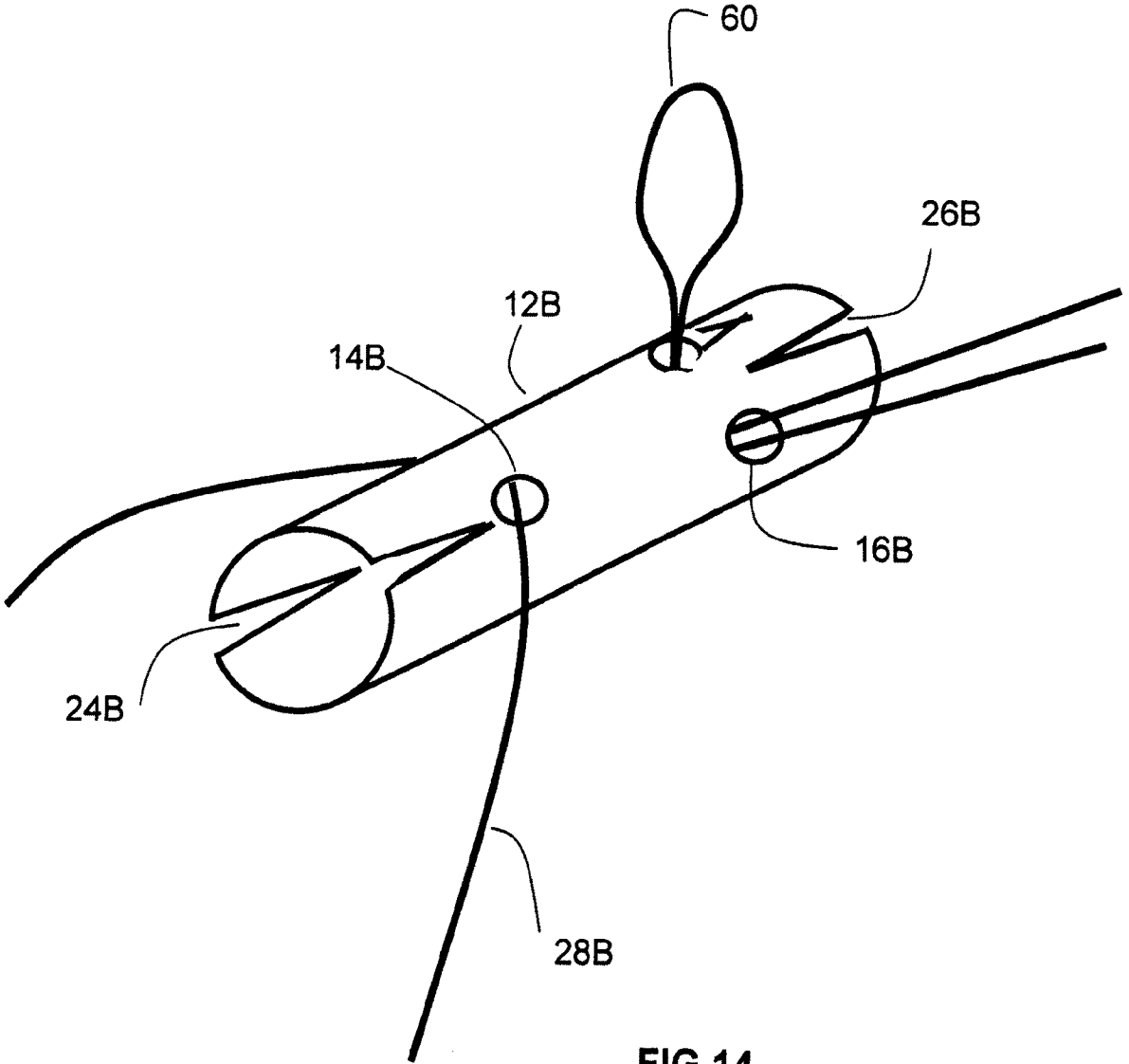
FIG. 14 is a close up perspective view of the handle member of the second embodiment of the bundling device illustrating the manner in which the alternative cordage element is secured.

The bundling procedure is identical to that previously described with the exception that there are no loose ends and that the cordage loop 60 distant from the handle member 12B is brought up over the bundle so that the cordage engages two adjacent sides and then as illustrated in FIG. 14, the end of the loop is inserted through the second set of apertures 16B in handle member 12B, drawn taught, with the excess being wrapped about the end notches 24B and 26B.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An apparatus for bundling newspapers for recycling, said apparatus comprising:

a bundle of newspapers to be secured for recycling, said bundle of newspapers defined by a lower face, upper face, and four side walls;

an elongate handle member, said elongate handle member having a first end and a second end, said elongate handle member having first and second spaced apart throughbores perpendicular to an elongate axis of said handle member, said handle member further having indented notches formed in said first end and said second end of said handle member;

a cordage member comprised of string or twine, said cordage member positioned through said first throughbore in said handle member so as to define two legs of said cordage member, each of said legs having a handle end and a loose end, said legs positioned on a flat surface and overlapped so as to form an X intersection and define a loop between said X intersection and said handle member, said bundle of newspapers to be secured for recycling positioned on said X intersection at a 45 degree angle, said handle member positioned on said upper face of said bundle of newspapers with said handle end portions of said legs of said cordage extending upwardly along two adjacent said side walls, said loose ends of said legs of said cordage extending upwardly to said upper face of said bundle of newspapers, said loose ends of said legs of said cordage members inserted through said second throughbore of said handle member and drawn taut and wrapped about said notches in said first end and said second end of said handle member.

2. The apparatus for bundling newspapers for recycling in accordance with claim 1 wherein said loose ends of said legs of said cordage member are inserted through said second throughbore of said handle member in opposite directions.

3. The apparatus for bundling newspapers for recycling in accordance with claim 1 wherein said handle member is cylindrical.

4. The apparatus for bundling newspapers for recycling in accordance with claim 1 wherein said handle member is tubular having an axial throughbore.

5. The apparatus for bundling newspapers for recycling in accordance with claim 1 wherein said spaced apart throughbores in said handle member are in parallel relationship to each other.

6. The apparatus for bundling newspapers for recycling in accordance with claim 1 wherein said spaced apart throughbores in said handle member are in spaced apart perpendicular relationship to each other.

7. The apparatus for bundling newspapers for recycling in accordance with claim 1 wherein said indented notches formed in said first end and said second end of said handle member are V-shaped.

8. The apparatus for bundling newspapers for recycling in accordance with claim 1 wherein one of spaced apart throughbores is formed with a locking slot.

9. The apparatus for bundling newspapers for recycling in accordance with claim 1 wherein said legs of said cordage member overlapped so as to form an X intersection are maintained in position by adhesing the two legs of said cordage member between two pieces of newspaper to be recycled.

10. A method for bundling newspapers for recycling, said method comprising:

forming an elongate handle member having first and second ends, and first and second spaced apart throughbores perpendicular to an elongate axis of said handle member, and further forming an indented notch in each said first and second ends of said handle member;

inserting a cord through said first throughbore of said handle member so as to form two substantially equal legs of cord;

overlapping said legs of cord to form an X intersection on a flat surface and defining a loop between said X intersection and said handle member;

orienting a bundle of newspapers on said X intersection at an approximately 45 degree angle with said X intersection;

positioning said handle member on top of said bundle of newspapers with said legs forming said loop extending upwardly on adjacent sides of said bundle of newspapers;

drawing loose ends of said cord of said two opposing sides of said bundle of newspapers and inserting said loose ends through said second throughbore;

drawing said loose ends of said cord taut with said handle member, and;

wrapping said loose ends about said notches to secure said bundle of newspapers.

11. The method for bundling newspapers for recycling in accordance with claim 10 wherein said legs of said cordage member overlapped so as to form an X intersection are maintained in position by adhesing the two legs of said cordage member between two pieces of newspaper to be recycled.

12. An apparatus for bundling newspapers for recycling, said apparatus comprising:

a bundle of newspapers to be secured for recycling, said bundle of newspapers defined by a lower face, upper face, and four side walls;

an elongate handle member, said elongate handle member having a first end and a second end, said elongate handle member having first and second spaced apart throughbores perpendicular to an elongate axis of said handle member, said handle member further having indented notches formed in said first end and said second end of said handle member;

a cordage member comprised of string or twine, said cordage member positioned through said first throughbore in said handle member so as to define a continuous loop of said cordage member, said cordage positioned on a flat surface and overlapped so as to form an X intersection and defining two loops, said bundle of newspapers to be secured for recycling positioned on said X intersection at a 45 degree angle, said handle member positioned on said upper face of said bundle of newspapers with said handle and a first loop of said cordage member extending upwardly along two adjacent said side walls, said second loop of said cordage member extending upwardly to said upper face of said bundle of newspapers securing two adjacent sides of said bundle of newspapers, said second loop of said cordage member inserted through said second throughbore of said handle member and drawn taut and wrapped about said notches in said first end and said second end of said handle member.

* * * * *